US005692844A

United States Patent [19]

Harrison et al.

[11] Patent Number: 5,692,844

[45] Date of Patent: Dec. 2, 1997

[54] RE-APPLICATION OF DYE TO A DYE DONOR ELEMENT OF THERMAL PRINTERS

[75] Inventors: Daniel Jude Harrison; Susan Lee Dawson, both of Pittsford, N.Y.

[73] Assignee: Eastman Kodak Company, Rochester, N.Y.

[21] Appl. No.: 704,297

[22] Filed: Aug. 29, 1996

[51] Int. Cl.[6] ..... B41J 31/16

[52] U.S. Cl. ..... 400/202.4; 400/198

[58] Field of Search ..... 400/194, 197, 400/198, 200, 202.2, 202.1, 202.3, 202.4, 202, 201

[56] References Cited

U.S. PATENT DOCUMENTS

| | | |
|---|---|---|
| 4,414,555 | 11/1983 | Becker . |
| 4,504,840 | 3/1985 | Evans et al. . |
| 4,661,393 | 4/1987 | Uchiyama et al. . |
| 4,695,288 | 9/1987 | Ducharme . |
| 4,700,207 | 10/1987 | Vanier et al. . |
| 4,713,281 | 12/1987 | Shini . |
| 4,737,486 | 4/1988 | Henzel . |
| 4,865,913 | 9/1989 | Takeuchi et al. . |
| 4,894,283 | 1/1990 | Wehr . |
| 4,988,667 | 1/1991 | Long . |
| 5,043,318 | 8/1991 | Kawakami et al. . |
| 5,090,828 | 2/1992 | Shimura et al. . |
| 5,118,657 | 6/1992 | Kawakami et al. . |
| 5,137,382 | 8/1992 | Miyajima . |
| 5,286,521 | 2/1994 | Matsuda et al. . |
| 5,334,574 | 8/1994 | Matsuda et al. . |
| 5,347,344 | 9/1994 | Itoh . |
| 5,376,619 | 12/1994 | Mochizuki et al. . |

*Primary Examiner*—Ren Yan

*Attorney, Agent, or Firm*—Milton S. Sales

[57] ABSTRACT

Apparatus is disclosed for re-applying dye to a dye donor element of a dye transfer thermal printer. A reservoir contains a supply of dye that is thermally transferred from the reservoir to the dye donor element by diffusion of dye into the dye donor element. The reservoir has a diffusion controlled permeation membrane through which dye is delivered to the dye donor element, while inhibiting diffusion of a carrier, whereby the dye partitions between the reservoir and the dye donor element but the carrier does not.

8 Claims, 1 Drawing Sheet

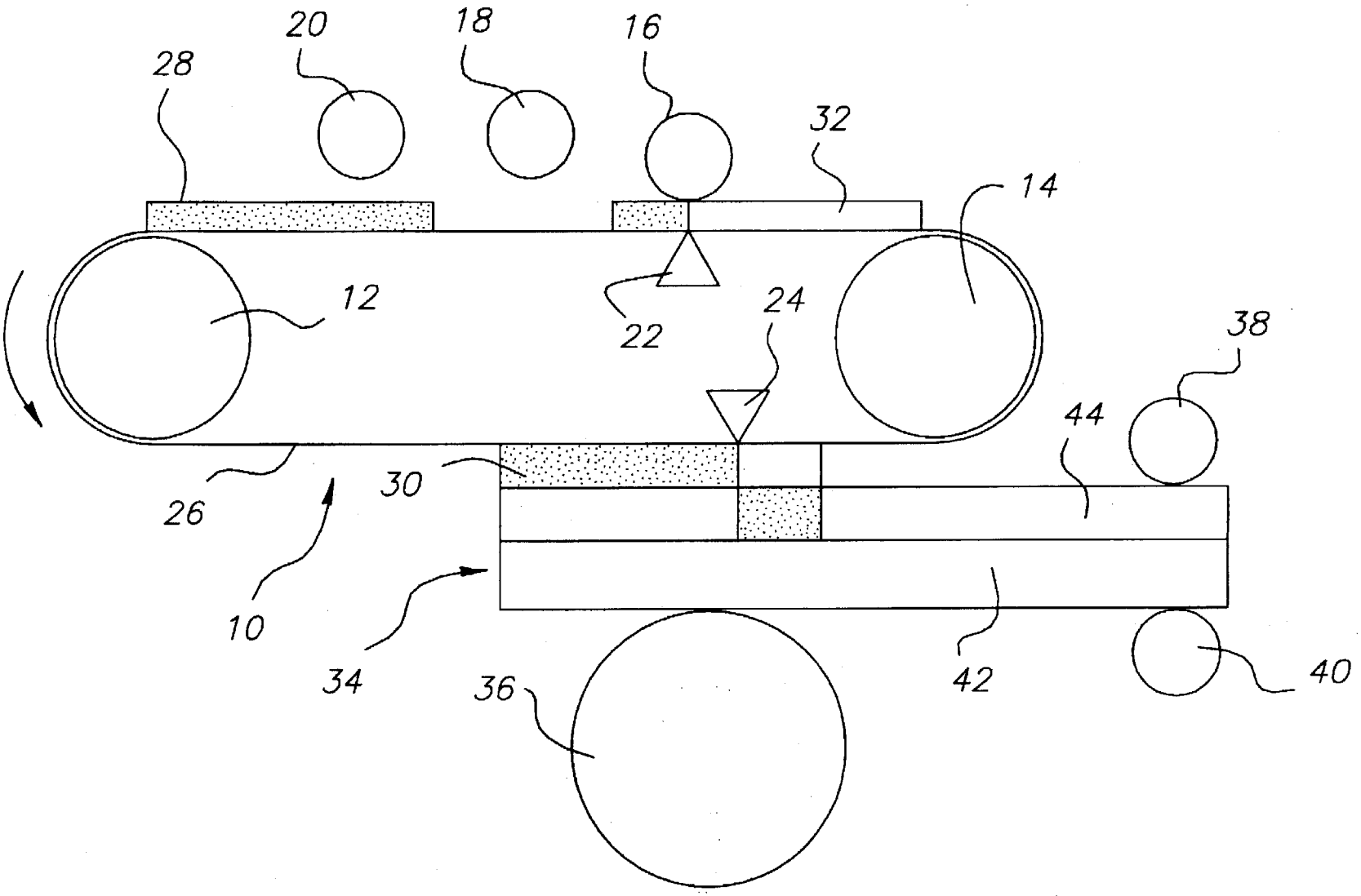
28
20
18
16
32
12
14
22
24
26
10
30
34
36
42
44
38
40

RE-APPLICATION OF DYE TO A DYE DONOR ELEMENT OF THERMAL PRINTERS

BACKGROUND OF THE INVENTION

1. Technical Field

This invention relates generally to resistive thermal printers, and more particularly to such printers having a reusable dye donor member.

2. Background Art

Color dye transfer thermal printers use a dye donor member which may be a sheet, but usually is in the form of a web advanced from a supply roll to a take-up roll. The dye donor member passes between a printhead and a dye receiver member. The thermal printhead comprises a linear array of resistive heat elements. In operation, the resistive heat elements of the printhead are selectively energized in accordance with data from a printhead control circuit. As a result, the image defined by the data from the printhead control circuit is placed on the receiver member.

A significant problem in this technology is that the dye donor members used to make the thermal prints are generally intended for single (one time) use. Thus, although the member has at least three times the area of the final print and contains enough dye to make a solid black image, only a small fraction of this dye is ever used.

After printing an image, the dye donor member cannot be easily reused, although this has been the subject of several patents. The primary reason that inhibits reuse of the dye donor members is that the dye transfer process is very sensitive to the concentration of dye in the donor layer. During the first printing operation, dye is selectively removed from the layer thus altering its concentration. In subsequent printings, regions of the donor member which had been previously imaged have a lower transfer efficiency than regions which were not imaged. This results in a ghost image appearing in subsequent prints.

The cost associated with having a single use donor ribbon is large because of the large area of ribbon required, as well as the large excess of dye coated on the donor member. While this technology is able to produce high quality continuous tone color prints, it is desired to provide an approach which has all of the good attributes of thermal dye transfer imaging but without the limitations associated with single use donor members.

Some work has been done by others to accomplish similar goals. For example, U.S. Pat. No. 5,286,521 discusses a reusable wax transfer ink donor ribbon. This process is intended to provide a dye donor ribbon that may be used to print more than one page before the ribbon is completely consumed. U.S. Pat. No. 4,661,393 describes a reusable ink ribbon, again for wax transfer printing. The ink ribbon contains fine inorganic particles and low melting waxy materials to assist in the repeated use of this ribbon. U.S. Pat. No. 5,137,382 discloses a printer device capable of re-inking a thermal transfer ribbon. However, again the technology is wax transfer rather than dye transfer. In the device, solid wax is melted and transferred using a roller onto the reusable transfer ribbon.

U.S. Pat. No. 5,334,574 describes a reusable dye donor ribbon for thermal dye transfer printing. This reusable ribbon has multiple layers containing dye which limit the diffusion of dye out of the donor sheet. This enables the ribbon to be used to make multiple prints. In addition, the ribbon may be run at a slower speed than the dye receiver sheet, enabling additional utilization. U.S. Pat. No. 5,118,657 describes a multiple use thermal dye transfer ink ribbon. This ribbon has a high concentration dye layer on the bottom and a low concentration dye layer on the top. The low concentration dye layer meters or controls dye transfer out of the ribbon. This enables the ribbon to be used multiple times. U.S. Pat. No. 5,043,318 is another example of a thermal dye transfer ribbon which can be used multiple times.

U.S. Pat. No. 5,090,828 discloses a dielectric transfer technology for replenishing a donor sheet with small toner-like particles, filling in the regions where mass has been transferred from the ribbon.

U.S. Pat. No. 4,713,281 describes a multiple use pressure sensitive transfer recording medium.

U.S. Pat. No. 4,894,283 relates to a reusable thermal mass transfer ribbon consisting of carbon black, hydrocarbon wax and a thermal plastic resin.

U.S. Pat. No. 4,865,913 shows to a multiple use thermal mass transfer ink sheet, having an ink holding, porous membrane layer filled with hot melt ink.

U.S. Pat. No. 5,376,619 teaches a thermal dye transfer process in which a donor ribbon may be run at a slower speed than a receiver, thus generating a greater utilization of the donor ribbon.

U.S. Pat. No. 5,347,344 describes an electro-photographic type process, in which waxy toner particles are transferred in an image-wise fashion onto a reusable donor ribbon. The donor ribbon then subsequently transfers the toner image onto a receiver sheet using a thermal print head.

U.S. Pat. No. 4,504,840 discloses a reusable ribbon which is re-inked after printing by transferring wax transfer type colorant back to the ribbon in the liquid state. This method also discloses the use of a resistive ribbon type printing technology.

U.S. Pat. No. 4,414,555 relates to a process in which a mass transfer type printing ribbon is used to transfer an image to a receiving sheet. The used ribbon is then re-inked in this process, enabling it to be reused.

Accordingly, there is no prior art known to us which directly relates to the concept of the reapplication of dye to a dye donor ribbon. Techniques have been used in wax transfer printing to replenish a used donor ribbon. However, in such techniques, a mass transfer of wax back onto the donor sheet is used, rather than a re-diffusion of dye back into the donor layer. Similarly, the concept of replenishing a resistive ribbon thermal transfer sheet has been disclosed, but again only in the context of wax transfer imaging. There are several disclosures for reusable thermal dye transfer ribbons. However, these ribbons attempt to control the diffusion of dye out of the ribbon so that they could print multiple times, rather than enable the re-diffusion of dye back into the ribbon as in the present invention concept.

DISCLOSURE OF THE INVENTION

It is a feature of the present invention to provide apparatus for re-applying dye to a dye donor element of a dye transfer thermal printer. A reservoir contains a supply of dye that is transferred from the reservoir to the dye donor element by diffusion of dye into the dye donor element.

It is another feature of the present invention to provide apparatus for re-applying dye to a dye donor element of a dye transfer thermal printer. A reservoir containing a supply of dye has a diffusion controlled permeation membrane through which dye is delivered to the dye donor element.

It is still another feature of the present invention to provide apparatus for re-applying dye to a dye donor element of a dye transfer thermal printer. A reservoir containing a supply of dye and carrier has a diffusion controlled permeation membrane. The diffusion controlled permeation membrane inhibits diffusion of the carrier, whereby the dye partitions between the reservoir and the dye donor element but the carrier does not. The reservoir may also include a porous sub-layer covered by the diffusion controlled permeation membrane through which dye is delivered from the sub-layer to the dye donor element. Further, the reservoir may be a roller with the membrane forming a cylindrical cover for the sub-layer.

In this method, dye is thermally transferred from a reservoir to the depleted donor patch. The dye and a carrier are contained in the reservoir. The reservoir is covered with a diffusion controlled permeation membrane. With the addition of heat, dye diffuses through the membrane and is delivered to the donor patch. The dye partitions between the reservoir and the donor patch reestablishing the original dye concentration.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawing, which is a schematic side view of a dye donor ribbon thermal printer according to the present invention.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Referring to the drawing, a reusable dye donor member is provided, such as in the form of a belt 10 that is trained about a pair of rollers 12 and 14. At least one of the two rollers is driven to advance belt 10 past a plurality of dye reservoir rollers 16, 18, and 20; one or more re-ink heads 22; and a printhead 24 at a printing station.

Donor member belt 10 comprises a support 26 and a dye donor element such as a plurality of dye donor patches 28, 30, and 32. Any material can be used as the support for the dye-donor element of the invention provided it is dimensionally stable and can withstand the heat of a laser or thermal head. Such materials include aluminum or other metals; polymers loaded with carbon black; metal/polymer composits such as polymers metalized with 500–1000 Å of metal; polyesters such as polyethylene terephthalate, polyethylene naphthalate, etc.; polyamides (such as nomex); polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5μ to about 200μ and may also be coated with a subbing layer, if desired, such as those materials described in U.S. Pat. Nos. 4,695,288 or 4,737,486.

In the illustrated embodiment, the dye donor element is formed of a distinct dye donor patch on the support for each color. However, a continuous dye donor element over the entire support surface may be used, with machine logic subdividing the single element into dedicated color regions. Likewise, more than three patches may be used. The dye donor is dispersed in a polymeric binder such as cellulose and derivatives of cellulose to include cellulose acetate hydrogen phthalate, cellulose acetate, cellulose acetate propionate, cellulose acetate butyrate, and cellulose triacetate, poly(vinyl acetal), poly(vinyl alcohol-co-butyral) and any of the polymers described in U.S. Pat. No. 4,700,207; polyurethanes, polyesters, polyamides, polyacrylamides, acrylates, poly(vinyl alcohol), polyimides, polyethers, polystyrene, poly(siloxanes), polysulfone, polycarbonate, acrylics, gelatin, polyolefin, poly(nitrile), poly(dienes), polyacetal, polybutural and their copolymers.

A conventional dye receiver medium 34 is drawn through a nip formed between printhead 24 and a platen roller 36 by a capstan drive roller pair 38 and 40. Dye receiver medium 34 is conventional, and includes a support 42 and a receiving layer 44. Image-wise activation of linear printhead 24 causes dye to be transferred from the dye donor element of belt 10 into the dye receiving layer of medium 34; at least partially image-wise depleting portions of the patches of dye.

Dye reservoir rollers 16, 18, and 20 include a permeation membrane. Examples of membrane material include cellulose and deviatized cellulose used alone or blended with other components, polyesters, polyamides, polysufone, crosslinked polystyrene, phenol/formaldehyde resin and fluorinated polymers to include polytetrafluoroethylene and polyvinylidene fluoride, polycarbonate, poly(vinyl alcohol) and silicon containing polymers. Membranes can be constructed from a dense layer of polymer supported on a porous sub-layer. These polymeric membranes can be crosslinked to further reduce permeability.

Dye reservoir rollers 16, 18, and 20 may be replaced by wicks formed of similar materials, but not mounted for rotation.

Each dye reservoir roller is opposed by re-ink head 22 (only one head is illustrated in the drawing), and the rollers are selectively raised and lowered into contact with belt 10 as necessary. When a dye reservoir roller is lowered to the belt, and the associated re-ink head activated, heat and/or pressure between the dye reservoir roller and belt 10 effects re-inking of the dye donor element, and the depleted dye donor layer of the patch is re-saturated with dye from the dye reservoir roller.

In this method, dye is thermally transferred from a reservoir to the depleted donor patch. The dye and a carrier are contained in the reservoir. The reservoir is covered with a diffusion controlled permeation membrane. With the addition of heat, dye diffuses through the membrane and is delivered to the donor patch. The dye partitions between the reservoir and the donor patch reestablishing the original dye concentration.

It is a feature of one aspect of the present invention that, during the re-diffusion, dye separates from the solvent. A semi-permeable membrane allows only the dye to diffuse out of the dye supply and into the donor member. Solvent is retained within the supply. Other methods of replenishment require that solvent is removed either prior to the replenishment step (intermediate transfer) or after transfer of dye to the donor ribbon. Solvents must be volatile in these alternative approaches. In addition, the removal of solvent results in more complex hardware as well as the potential health and safety problems associated with this process.

Dye transfer from the reservoir through the semi-permeable membrane may not require any carrier solvent. In a solid dye transfer mechanism, dye would melt and diffuse through the membrane to re-ink the donor patch.

The invention has been described in detail with particular reference to preferred embodiments thereof, but it will be understood that variations and modifications can be effected within the spirit and scope of the invention.

What is claimed is:

1. Apparatus for re-applying dye to a dye donor element of a dye transfer thermal printer, said apparatus comprising:

a thermal dye donor element;

a printing station at which dye is image-wise transferred from the dye donor element to a receiver medium, at least partially depleting the dye donor element of dye;

a reservoir containing a supply of dye, wherein the supply of dye includes dye and a dye carrier; and means for transferring dye from the reservoir to the dye donor element by separating the dye from the dye carrier by diffusion of dye through said dye transfer means and into the dye donor element.

2. Apparatus as set forth in claim 1 wherein the reservoir includes a diffusion controlled permeation membrane through which dye is delivered to the dye donor element, said permeation membrane separating the dye from the dye carrier.

3. Apparatus as set forth in claim 2 wherein the means for thermally transferring dye from the reservoir to the dye donor element includes a re-ink head adapted to apply heat to the reservoir, whereby the dye is caused to diffuse through the membrane to be delivered to the dye donor element.

4. Apparatus as set forth in claim 2 wherein the diffusion controlled permeation membrane inhibits diffusion of the carrier, whereby the dye partitions between the reservoir and the dye donor element but the carrier does not.

5. Apparatus as set forth in claim 1 wherein the reservoir includes a porous sub-layer covered by a diffusion controlled permeation membrane through which dye is delivered from the sub-layer to the dye donor element.

6. Apparatus as set forth in claim 5 wherein the reservoir is a roller with the membrane forming a cylindrical cover for the sub-layer.

7. A process for re-applying dye to a dye donor element of a dye transfer thermal printer, said process comprising the steps of:

providing a thermal dye donor element;

providing a printing station at which dye is image-wise transferred from the dye donor element to a receiver medium, at least partially depleting the dye donor element of dye;

providing a reservoir containing a supply of dye wherein the reservoir contains dye and carrier, and the dye is transferred from the reservoir through a diffusion controlled permeation membrane without the carrier; and providing means for transferring dye from the reservoir to the dye donor element by separating the dye from the dye carrier by diffusion of the dye through the dye transfer means and into the dye donor element.

8. A process as set forth in claim 7 wherein the dye is transferred from the reservoir through a diffusion controlled permeation membrane.

* * * * *